United States Patent [19]

Khan

[11] Patent Number: 4,528,825

[45] Date of Patent: Jul. 16, 1985

[54] FOLD-DOWN MULTIPLE POSITION SHELF FOR REFRIGERATOR

[75] Inventor: Aman U. Khan, Lincoln Township, Berrien County, Mich.

[73] Assignee: Whirlpool Corporation, Benton Harbor, Mich.

[21] Appl. No.: 642,586

[22] Filed: Aug. 20, 1984

[51] Int. Cl.[3] ..... F25D 11/02

[52] U.S. Cl. ..... 62/441; 312/313; 312/323

[58] Field of Search ..... 312/313, 323, 236, 246, 312/315, 325; 62/440, 441

[56] References Cited

U.S. PATENT DOCUMENTS 3,241,334 3/1966 Amore ..... 62/441 X 3,359,751 12/1967 Stevens ..... 62/441 X

*Primary Examiner*—Lloyd L. King

*Attorney, Agent, or Firm*—Hill, Van Santen, Steadman & Simpson

[57] ABSTRACT

A foldable refrigerator shelf is provided in which a lower shelf is nested directly beneath an upper shelf in a locked position and can be moved to a plurality of positions spaced from the upper shelf by means of sliding and pivoting links. The shelf is positively locked while in a folded position and is continuously biased into a stable position when in the open position.

12 Claims, 7 Drawing Figures

FIG. 5
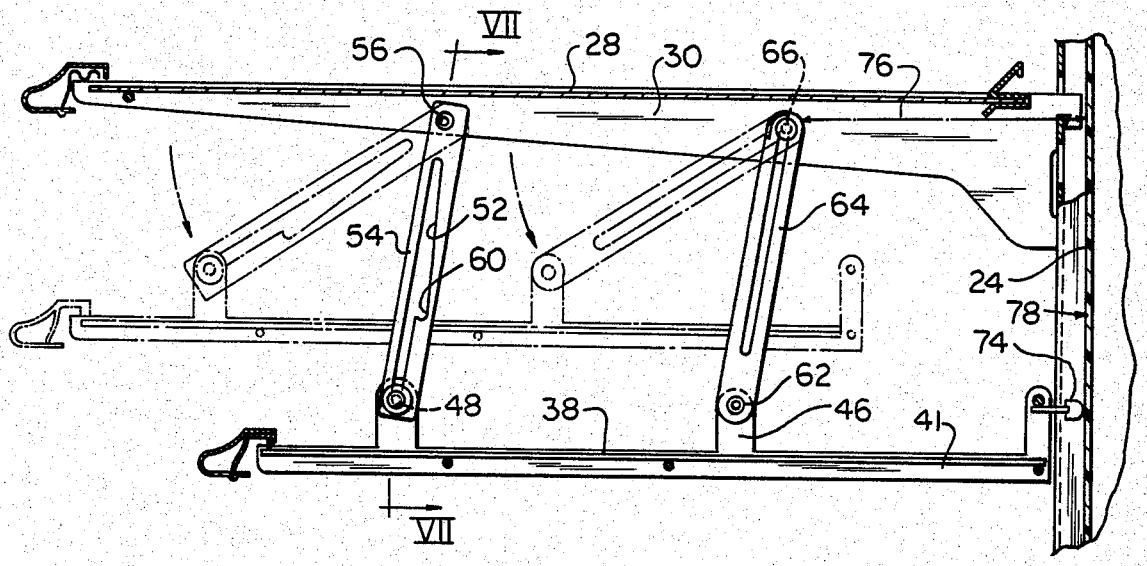
FIG. 6
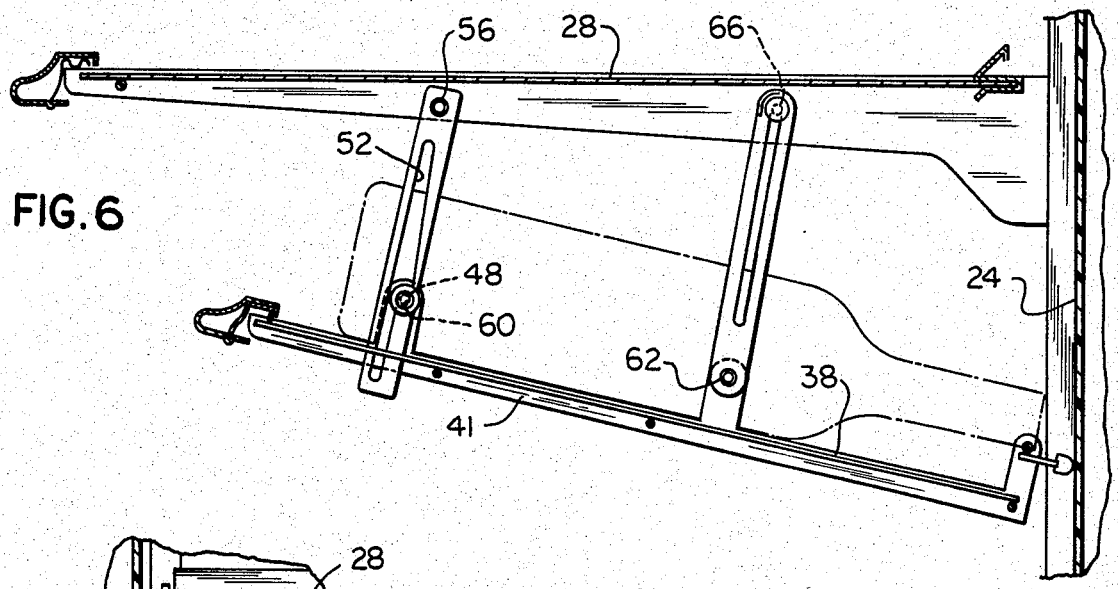
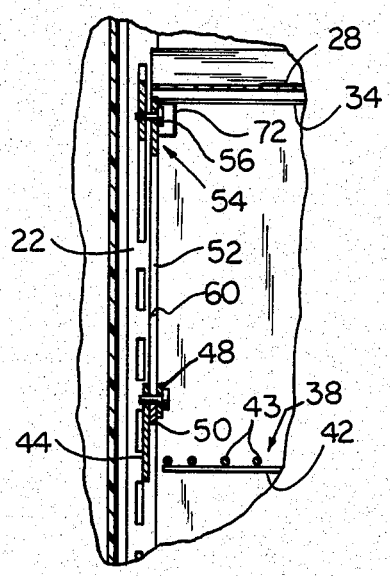
FIG. 7

FOLD-DOWN MULTIPLE POSITION SHELF FOR REFRIGERATOR

BACKGROUND OF THE INVENTION

1. Field of the Invention

The present invention relates to refrigeration apparatus and, more particularly, to an adjustable, foldable shelf suspended from cantilevered shelf support brackets in a refrigeration apparatus.

2. Description of the Prior Art

In an effort to make the interior space of a refrigerator more usable, manufacturers have provided shelves that are either foldable to a nonuse position or removable to give maximum flexibility. Vertically adjustable cantilevered refrigerator shelves are popular because they are very versatile and attractive in appearance. While various forms of foldable shelves are known, none of them are appropriate for suspension from a glass cantilevered refrigerator shelf.

Another limitation of most foldable shelves is that they are usually limited in size, not being useful across the full width of the interior of the refrigerator cabinet. In addition, most foldable refrigerator shelves suffer from being difficult to employ and expensive to manufacture.

Pivotal suspension links for foldable shelves are shown in U.S. Pat. Nos. 2,082,672; 2,598,266; 2,808,310; and 2,146,199. However, none of these prior patents discloses a foldable shelf in which a lower shelf member can be folded up underneath an upper shelf member in a stored position and can be unfolded into a plurality of positions for various uses by means of slidable pivotal links.

SUMMARY OF THE INVENTION

The present invention provides a multiple position refrigerator shelf that can be folded to a storage position immediately under the shelf above it, to minimize wasted space when not in use, but is readily movable to a spaced, suspended use position. The invention comprehends a foldable shelf having a third position tilted towards the rear of a refrigerator for storage of wine bottles. The suspended shelf is gravity biased against the rear wall of the refrigerator liner to add stability to the shelf. Further, the folded shelf is suspended from conventional vertically adjustable cantilevered brackets in the refrigerator and is useful with either glass or wire cantilevered shelves.

The present invention provides that the multiple position shelf is substantially the same size as the shelf above it, thus filling essentially the full interior width and depth of the refrigerator compartment. Further, the invention provides for a means for retaining the shelf in a folded storage position, against the force of gravity, which is very secure and avoids the use of conventional friction latching means, such that the effectiveness of the retaining means is relatively unaffected by wear over the life of the product.

BRIEF DESCRIPTION OF THE DRAWINGS

FIG. 5 is a side sectional view, similar to FIG. 3, showing the complete opening movement of the foldable shelf.

FIG. 6 is a side sectional view, similar to FIG. 3, showing the foldable shelf in a locked intermediate use position.

FIG. 7 is a sectional view of the link members taken generally along the lines VII—VII of FIG. 5.

DESCRIPTION OF THE PREFERRED EMBODIMENTS

Figure 1:
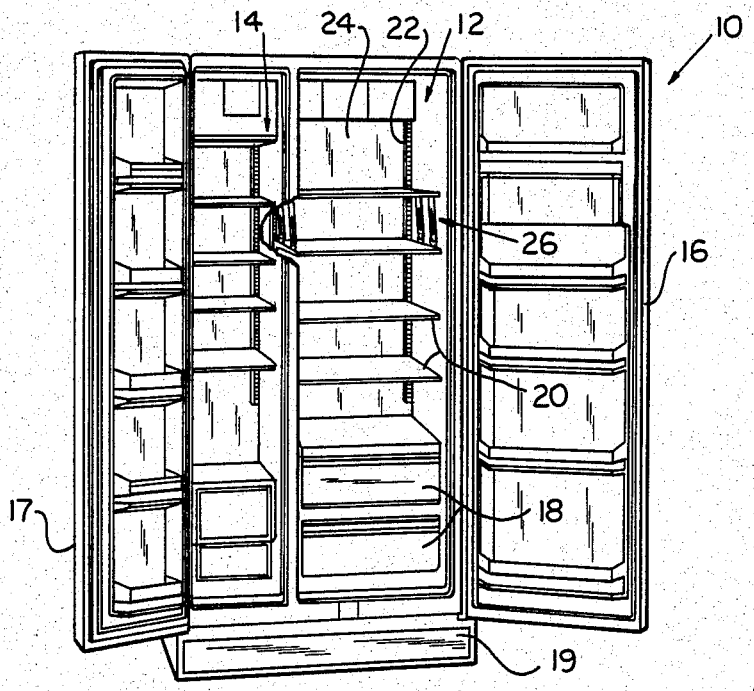
FIG. 1 is a perspective view of the interior of a refrigerator employing the present invention.

In FIG. 1, there is seen a refrigerator 10, commonly referred to as a side-by-side unit, with a refrigeration compartment 12 and a freezer compartment 14 separated by a dividing wall 15. Conventionally, the interior of refrigerator 10 is cooled by an evaporator (not shown) located in the freezer compartment and a compressor and a condenser (not shown) located in the machinery compartment 19. The refrigerator has openable doors 16 and 17 providing access to the interior of the refrigeration and freezer compartments, respectively. The refrigeration compartment is provided with a number of drawers 18 for storing food and also a plurality of vertically adjustable shelves 20. The shelves 20 are supported in cantilevered fashion by support members or ladders 22 which are secured to a rear liner wall 24 of the refrigeration compartment. A foldable shelf assembly 26 is shown in FIG. 1 and is shown in greater detail in FIGS. 2–7.

Figure 2:
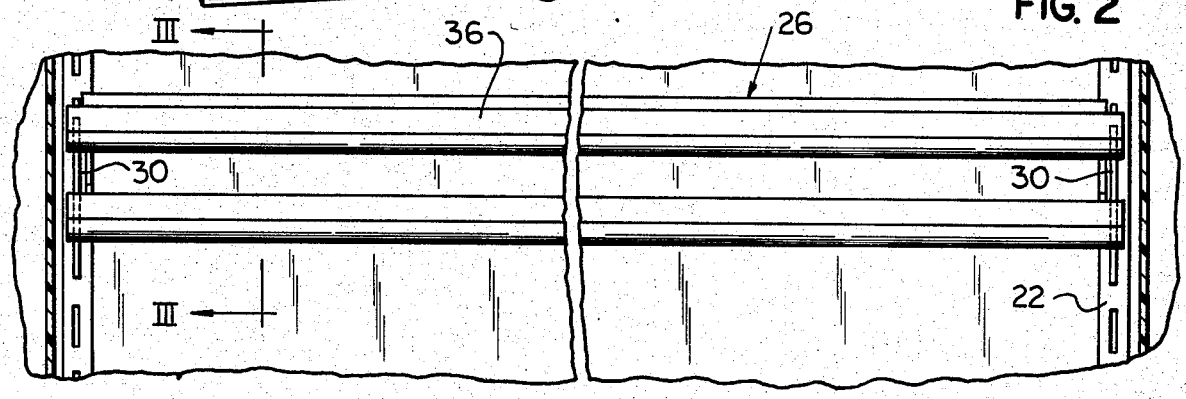
FIG. 2 is a partial front view of the foldable refrigerator shelf of the present invention shown in its folded position.
Figure 3:
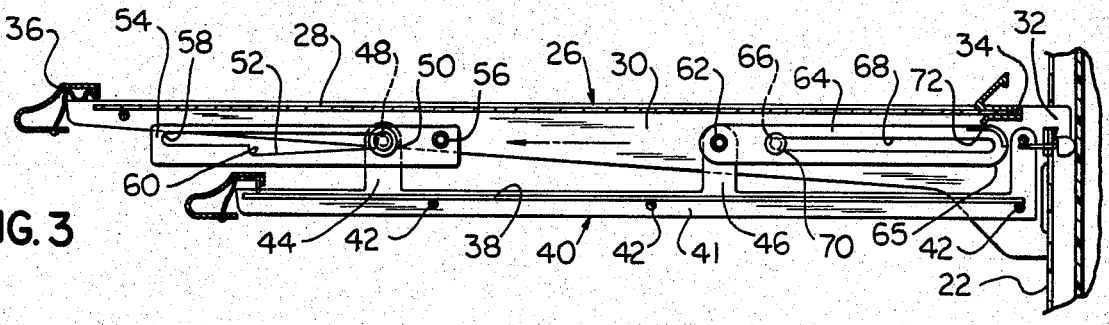
FIG. 3 is a side sectional view taken generally along the lines III—III of FIG. 2.

FIGS. 2 and 3 show the foldable shelf assembly 26 in the completely folded and locked position in which there is an upper glass or wire shelf member 28 supported on a pair of shelf support brackets 30, each having a projecting finger 32 at a rear end thereof which engages with the support ladder 22 such that the support bracket 30 is secured in a cantilevered position in a conventional manner.

The support brackets 30 are connected by a plurality of lateral connecting members 34 to maintain the supports in spaced parallel relationship and to add rigidity to the shelf support. A piece of front trim 36 extends across the front width of the upper shelf to provide a grasping surface for inserting the shelf and to provide a finished appearance.

A lower horizontal support surface, or shelf, 38 is movably carried on a support cradle 40. In the illustrated embodiment, shelf 38 is of wire construction but could also be made of glass. In the illustrated embodiment, cradle 40 is comprised of a pair of elongated arm members 41, each of which supports an opposite side edge of shelf 38. Arm members 41 are held in spaced parallel relationship by a plurality of cross-connecting members 42 transversely spanning the arm members 41. Wire members 43 attach to members 42 to support items placed on shelf 38. Each arm member 41 is suspended from, and is disposed directly below, one of the support brackets 30 (FIG. 7).

Hereinafter, the invention will be described in relation to one arm member 41, and associated structure, it being understood that in the preferred embodiment duplicate structure is provided to support an opposite side of shelf 38, as illustrated in FIG. 1.

Each arm member 41 has a front upstanding tab 44 and a rear upstanding tab 46. As shown in FIG. 7, the front tab 44 has a guide or pivot pin 48 extending perpendicularly therethrough at a top end thereof, the guide pin having an enlarged head 50. The guide pin is received within a slot 52 in a link member 54 which is pivotally secured at pivot pin 56 to the shelf support bracket 30. The enlarged head 50 ensures that the guide pin 48 will remain engaged within the slot 52. The slot 52 has a distal portion 58 which extends away from the pivot pin 56 toward the opposite end of the link 54. A step 60, sized to receive and retain the guide pin 48, is provided centrally along a bottom edge of the slot 52.

The rear upstanding tab 46 has a pivot pin 62 near a top end thereof to which is pivotally connected a rear link member 64. The shelf support bracket 30 has a guide or pivot pin 66 projecting therefrom which extends into a slot 68 in the rear link member 64. The guide pin 66 has an enlarged head 70 to ensure that the guide pin 66 remains engaged within the slot 68. The slot 68 is of a uniform width throughout its length.

The rear link 64 has a shoe member 72 affixed to a distal end 65 from pin 62 of the link 64. Shoe member 72 engages a fixed stop 73, which is attached to shelf support bracket 30, when the lower shelf 38 is in the folded position, shown in FIG. 3. The engagement of the shoe member 72 with fixed stop 73 prevents rotation of link member 64 about guide pin 66, thereby securely retaining or locking the lower shelf 38 in the folded storage position.

Figure 4:
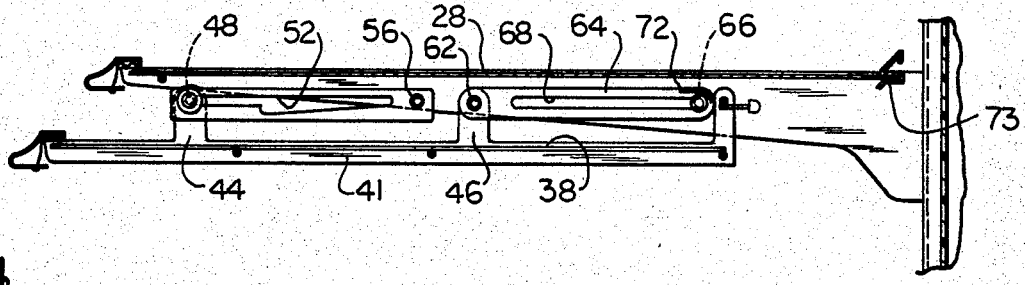
FIG. 4 is a side sectional view, similar to FIG. 3, showing the foldable shelf in a partially opened position.

To move the lower shelf 38 to the open use position, the first step is to pull the lower shelf forwardly toward the user (or to the left as seen in FIGS. 3 and 4) until the shelf is pulled all the way out as seen in FIG. 4. During this operation, the guide pin 48 on tab 44 slides along slot 52, while link member 54 remains essentially stationary, and the link member 64 is pulled forwardly through its pivot pin 62 at tab 46 such that the link member 64 slides relative to guide pin 66. When the lower shelf 38 is pulled all of the way forward, as seen in FIG. 4, link member 64 may be pivoted about pin 66 which has moved relative to slot 68 such that it is near the distal end 65 of link member 64, and pivoting movement of link member 64 can occur without the shoe member 72 engaging stop 73.

Once the lower shelf 38 has been pulled completely forward, then it can swing downwardly as seen in FIG. 5. At this point, the link members 54, 64 pivot at each end around pins 48, 56 and 62, 66 respectively. The lower shelf 38 continues to swing downwardly until a bumper member 74 engages the rear liner wall 24 of the refrigeration compartment. The distance 76 from the rear liner wall 24 to the rear guide pin 66 attached to the shelf support bracket 30 is less than the distance 78 from the rear liner wall 24 to the pivot pin 62 secured to the rear upstanding tab 46 on the arm member 41 such that there is a continuing gravity bias downwardly and rearwardly to hold the lower shelf member 38 securely against the liner wall 24 of the refrigeration compartment, thereby stabilizing the lower shelf 38. The pins 56 and 48 have a similar relationship to the rear liner wall 24 to further aid in stabilizing the shelf member 38 against wall 24. Thus, in the use position shown in FIG. 5, the lower shelf 38 is securely held in a spaced, parallel position relative to the upper shelf 28.

In FIG. 6, the lower shelf 38 is shown in an alternative use position relative to the upper shelf member 28. In this position, the lower shelf 38 is angled upwardly toward the front of the refrigerator by means of guide pin 48 being captured within step 60 in slot 52. This angled position is convenient for storing wine bottles and other similar containers. Again, in this position, the lower shelf 38 is stably held against the rear liner wall 24 by gravity bias produced by the positioning of pins 66 and 56 on the shelf support bracket relative to pivot pins 62 and 48 on the arm member.

To refold the lower shelf 38 up to the storage position adjacent upper shelf 28, a reverse procedure of that described above is conducted. That is, the bottom shelf 38 is pivoted forwardly and upwardly to the position shown in FIG. 4 and then is slid directly back under the upper shelf to the folded and locked position of FIG. 3.

It is thus seen that a fold-down refrigerator shelf is provided which is suspended by a set of slidable pivotal link members 54, 64 in which each link member is allowed to slide along its longitudinal axis with respect to one of its pivots. The rearward link member 64 is slidable with respect to the fixed upper guide pin 66 to selectively interact with a fixed stop member 73 and the forward link member 54 is slidable with respect to the lower guide pin 48 attached to arm member 41.

As is apparent from the foregoing specification, the invention is susceptible of being embodied with various alterations and modifications which may differ particularly from those that have been described in the preceeding specification and description. It should be understood that I wish to embody within the scope of the patent warrented hereon all such modifications as reasonably and properly come within the scope of my contribution to the art.

The embodiments of the invention in which an exclusive property or privilege is claimed are defined as follows:

1. In a refrigeration apparatus having a cabinet defining a refrigerated compartment, and a forwardly extending horizontal shelf support bracket within said refrigerated compartment, a fold-down shelf attached to said bracket comprising:

a movable shelf member;

a first pivotal link;

a second pivotal link;

said shelf member supported below said bracket at a front portion by said first link and at a rear portion by said second link, said shelf member movable between a storage position adjacent said bracket and at least one use position spaced downwardly from said bracket;

a first pivot means associated with each said pivotal link for pivotally connecting said pivotal link to said bracket;

a second pivot means associated with each said pivotal link for pivotally connecting said pivotal link to said shelf member;

slide means formed on each pivotal link associated with one of said first pivot means or said second pivot means for allowing said pivot means associated therewith to slide longitudinally along said pivotal link toward the other said pivot means when said shelf member is moved from said use position to said storage position; and retaining means selectively maintaining said shelf member in said storage position, whereby said movable shelf member is moved from said use position to said storage position by moving said shelf member forwardly and upwardly until said pivotal links are horizontally oriented then sliding said shelf member rearwardly until said retaining means is engaged.

2. The refrigeration apparatus according to claim 1 wherein a second support bracket, with two associated links, is additionally provided to support said fold-down shelf.

3. The refrigeration apparatus according to claim 1 wherein said fold-down shelf has a horizontal use position and a tilted use position.

4. The refrigeration apparatus according to claim 1 wherein means are provided to continuously bias said fold-down shelf into a stable position in said use position.

5. The refrigeration apparatus according to claim 1 wherein said first pivot means comprises a guide pin slidable relative to said second link and said second pivot means comprises a guide pin slidable relative to said first link.

6. The refrigeration apparatus according to claim 1 wherein said retaining means comprises engagement means between one of said pivotal links and said bracket to prevent said one of said pivotal links from rotating.

7. In a refrigeration apparatus having a cabinet defining a refrigerated compartment, and a pair of spaced, horizontally disposed shelf support brackets within said refrigerated compartment, said shelf support brackets having a forward portion and a rearward portion, a fold-down shelf suspended below shelf support brackets, said fold-down shelf being movable between a storage position adjacent said support brackets and a use position spaced downwardly from said support brackets, said fold-down shelf comprising:

a movable, generally horizontal support surface having a forward portion and a rearward portion;

a pair of forward pivotal links suspending said forward portion of said horizontal support surface from said forward portion of said support brackets;

a pair of rearward pivotal links suspending said rearward portion of said horizontal support surface from said rearward portion of said support brackets;

first pivot means for pivotally connecting each of said forward pivotal links and said rearward pivotal links to one of said support brackets;

second pivot means for pivotally connecting each of said forward pivotal links and said rearward pivotal links to said horizontal support surface;

whereby said pivotal links move from a substantially vertical to a substantially horizontal position when said horizontal support surface is moved from said use position to said storage position;

slot means formed on each said pivotal link slidably receiving either said first pivot means or said second pivot means for allowing the pivot means received thereby to longitudinally slide along said pivotal link toward the other pivot means when said horizontal surface is moved from said use position to said storage position, and storage position retaining means connected to said support brackets for selectively preventing rotation of one said pair of pivotal links from said substantially horizontal position to retain said horizontal support surface in said storage position.

8. The refrigeration apparatus according to claim 7 wherein said slot means on each of said forward pivotal links slidably receives said second pivot means and said slot means on each of said rearward pivotal links slidably receives said first pivot means.

9. The refrigeration apparatus according to claim 7 wherein said retaining means comprises a superjacent stop which selectively bears against said rearward links.

10. In a refrigeration apparatus having a cabinet defining a refrigerated compartment having a rear wall and a front opening, a pair of horizontally spaced, vertical support ladders mounted to said rear wall, a pair of shelf support brackets cantilevered from said pair of support ladders and a fixed shelf supported by said vertical support brackets, a fold-down shelf suspended from said shelf support brackets, said fold-down shelf movable between a storage position adjacent said support brackets and a use position downwardly from said support brackets, said fold-down shelf comprising:

a movable, horizontal support surface having a forward portion adjacent said front opening, a rearward portion adjacent said support ladders, and opposing side edges;

a pair of spaced forward pivotal links connected one each to one of said opposing side edges for suspending said forward portion of said horizontal surface, each said forward pivotal link elongated in shape and forming an elongated first interior slot, said first interior slot having a first end and a second end;

a pair of spaced rearward pivotal links connected one each to one of said opposing side edges for suspending said rearward portion of said horizontal surface, each said rearward pivotal link elongated in shape and forming an elongated second interior slot, said second interior slot having a first end and a second end;

a pair of spaced first pivots, each said first pivot pivotally connecting one of said forward pivotal links to one of said shelf support brackets adjacent said first end of said first interior slot;

a pair of spaced second pivots, each said second pivot pivotally connecting one of said rearward pivotal links to one of said opposing side edges of said horizontal surface adjacent said first end of said second interior slot;

a pair of spaced guide pins attached one each to one of said opposing side edges of said horizontal surface forward portion, each said guide pin extending through one of said first interior slots, and arranged to slide therein;

another pair of spaced guide pins attached one each to one of said support brackets, each said other guide pin extending through one of said second interior slots and arranged to slide therein; and stop means attached to said support bracket for selectively engaging one of said rearward pivotal links preventing said rearward pivotal links from rotating when said horizontal support surface is in said storage position, whereby with said horizontal surface in said use position, said forward links and said rearward links are substantially vertical and said guide pins are at said second ends of their respective interior slots, and with said horizontal surface in said storage position, said forward link and said rearward link are substantially horizontal, said guide pins are at said first ends of their respective interior slots and said stop means is engaged with said one of said rearward pivotal links.

11. The refrigeration apparatus according to claim 10 wherein each said first interior slot has a notch intermediate said first end and said second end and wherein said horizontal surface has a tilted-use position with said forward links and said rearward links substantially vertical and with one said guide pin in each said notch.

12. The refrigeration apparatus according to claim 10 wherein the distance from said first pivots to said support ladder is less than the distance from said guide pins to the edge of said horizontal surface rearward end, and wherein the distance from said other guide pins to said support ladder is less than the distance from said second pivots to the edge of said horizontal surface rearward end, so that said horizontal surface is gravity biased toward said support ladder in said use position.

* * * * *